US009773585B1

(12) United States Patent
Rogers

(10) Patent No.: US 9,773,585 B1
(45) Date of Patent: Sep. 26, 2017

(54) FIRE RESISTANT COAXIAL CABLE

(71) Applicant: American Fire Wire, Inc., Minden, NV (US)

(72) Inventor: William E. Rogers, Alamo, CA (US)

(73) Assignee: AMERICAN FIRE WIRE, INC., Minden, NV (US)

( * ) Notice: Subject to any disclaimer, the term of this patent is extended or adjusted under 35 U.S.C. 154(b) by 0 days.

(21) Appl. No.: 15/385,585

(22) Filed: Dec. 20, 2016

(51) Int. Cl.

| | |
|---|---|
| ***H01B 7/295*** | (2006.01) |
| ***H01B 7/20*** | (2006.01) |
| ***H01B 11/18*** | (2006.01) |
| ***H01B 7/22*** | (2006.01) |
| ***H01B 7/02*** | (2006.01) |
| ***H01B 3/12*** | (2006.01) |

(52) U.S. Cl.
CPC ..... *H01B 7/295* (2013.01); *H01B 3/12* (2013.01); *H01B 7/0275* (2013.01); *H01B 7/20* (2013.01); *H01B 7/228* (2013.01); *H01B 11/1813* (2013.01)

(58) Field of Classification Search
CPC ..... H01B 7/0208; H01B 7/295
USPC ..... 174/105 R, 120 R, 121 A
See application file for complete search history.

(56) References Cited

U.S. PATENT DOCUMENTS

| | | | | |
|---|---|---|---|---|
| 3,299,202 | A * | 1/1967 | Brown | H01B 7/046 174/110 R |
| 5,457,285 | A * | 10/1995 | Faust | H01B 7/282 174/10 |
| 6,387,518 | B1 * | 5/2002 | Wolfer | C08K 3/22 106/18.12 |
| 7,304,245 | B2 * | 12/2007 | Alexander | H01B 3/12 174/110 R |
| 7,538,275 | B2 | 5/2009 | Konnik et al. | |
| 9,449,741 | B2 | 9/2016 | Abe et al. | |
| 9,450,352 | B2 | 9/2016 | Miyawaki | |
| 2014/0037956 | A1 * | 2/2014 | Sopory | H01B 7/292 428/368 |
| 2015/0060106 | A1 * | 3/2015 | Polasky | H01B 3/28 174/110 S |

OTHER PUBLICATIONS

3M™ Nextel™ Ceramic Fibers and Textiles, 3M Science Applied to Life, retrived on Nov. 9, 2016 at http://www.3m.com/3M/en-US/company-us/all-3m-products/~/All-3M-Products/Chemicals-Advanced-Materials/Advanced-Ceramics/Ceramic-Fibers-and-Textiles, 11 pages.

Alsecure® Premium Multicore Ceramifiable®, Alsecure® Premium Multicore, published Nov. 19, 2016, http://www.olex.com.au, 2 pages.

(Continued)

*Primary Examiner* — Chuan N Nguyen
(74) *Attorney, Agent, or Firm* — Kilpatrick Townsend & Stockton LLP

(57) ABSTRACT

A fire-resistant coaxial cable is described in which the dielectric between the central conductor and outer coaxial conductor can ceramify under high heat. The dielectric is composed of a ceramifiable silicone rubber, such as that having a polysiloxane matrix with inorganic flux and refractory particles. An outer wrap of ceramic fiber yarn surrounds the outer conductor and continues to insulate it from the outside if a low smoke zero halogen jacket burns away. Embodiments include those with durable corrugated outer conductors or flexible braided outer conductors. Methods of testing and installation are described.

20 Claims, 8 Drawing Sheets

(56) References Cited

OTHER PUBLICATIONS

Ceram Polimerik—The Worlds Hottest Company in Fire Protection Technology, Global Intelligence of Fire Protection Industry Worldwide, Market Analysis of Projects and Developments, Fire Prevention-Active and Passive Fire Protection, Press Room, http://hkc22.com/fireprotectionindustry_pressroom_ceram_polymerik.htnnl, retrieved on Nov. 18, 2016, 3 pages.
Ceramifiable Silicone Rubber Compound for Fire Resistant Cable—Anpin Silicone Material Co., Ltd., http://anpin.en.explaza.net/ceramifiable-silicone-rubber-compund-for--94686-3590090.html, retrieved on Sep. 26, 2016, 3 pages.
Di et al., "A novel EVA composite with simultaneous flame retardation and ceramifiable capacity," RSC Advances, 2015, vol. 5, pp. 51248-51257, DOI:10.1039/C5RA05781G.
Fire-Resistant Cables, Fanton, 1 page.
Korean Ceramifiable® cables that can take the heat, Nexans, http://www.nexans.com/eservice/navigation/NavigationPublicationOnly.nx?forPrint=true&publicationld=-33641, 1 pages.
Wilson, Dean K., "Circuit Integrity Cable Re-examined," Consulting-Specifying Engineer, Mar. 1, 2002, http://www.csemag.com/industry-new/codes-and-updates/single-article/circuit-integrity-cable-re-examined, retrieved on Sep. 19, 2016, 2 pages.

* cited by examiner

CORRUGATED COAX CABLE

FIRE RESISTANT COAXIAL CABLE

CROSS-REFERENCES TO RELATED APPLICATIONS

Not Applicable

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present application generally relates to electrical cables, including selection of materials for their conductive, insulating, or dielectric properties. Specifically, the application is related to fire-resistant co-axial cables with ceramifiable silicone rubber or ceramic fiber dielectric between the conductors and outside of the outer conductor.

2. Description of the Related Art

Since the Sep. 11, 2001 attacks on the World Trade Center and Pentagon, there has been a world-wide emphasis on improving communications during emergencies. In the first minutes of an emergency, communication among civilians and first responders is often through wireless communication devices, such as cellular telephones. While wireless signals, being electromagnetic radiation typically in the radio frequency (RF) range, are impervious to damage and do not depend on wires for transmission, the wireless signals depend on other infrastructure to communicate. This infrastructure includes antennas, switching equipment, towers, repeaters—and wires.

Ground zero of a disaster, man-made or natural, is often localized to a particular geographic area. At least some local cell towers may be operational. But cell phones within large buildings often do not connect directly with cell towers. Such buildings, as well as shopping centers and stadiums, may have too many obstacles and reflections for conventional cell phone-to-tower connections. For example, the metal reflective film applied to glass facades of commercial buildings prevents transmission of RF energy outside the building. Or the buildings may simply be too large for RF signals to reach a nearby cell tower, such as is the case with stadiums.

A cellular distributed antenna system (DAS) is often employed within buildings and other facilities in order to facilitate transmission of signals between occupants' cell phones and local cell towers. Multiple antennas are located throughout the facility, such as on each floor. Signals to and from the distributed antennas are routed—by cable—through a central processing rack in the basement or on the first or top floor. One or more cables connects the central processing rack to an outside antenna that is pointed or otherwise configured to optimally communicate with a local cell tower. The outside antenna is often located on a building's roof.

An Emergency Responder Radio Coverage System (ERRCS) DAS may also be employed within facilities. An ERRCS DAS boosts radio signals for firemen, policemen, and other first responders, similarly to a cellular DAS.

If there is an emergency in the building, a DAS may be critical for communications. Firefighters and policemen need to communicate with one another while responding. Users should be able to communicate with the outside as well. It may be especially unnerving for users to have their otherwise-normally-operational cell phones experience an outage during a building emergency.

It is for these and other reasons that building fire codes require DASes to meet certain survivability standards. For example, building fire codes sometimes dictate that communication cables connecting the DAS's antennas to the central processing/head-end rack and communication cables running from the rack to the outside antenna maintain operation at 1010° C. (1850° F.) temperatures for two hours. This standard can be found among the NFPA 72 (National Fire Alarm and Signaling Code), ICC IFC 510 (International Fire Code), and NFPA 1221 (Standard for the Installation, Maintenance, and Use of Emergency Services Communications Systems) codes.

Yet no such fire-resistant cables exist in a coaxial configuration. To maintain spacing between the central and outer conductors, common coax cables employ dielectrics that are air-based (foam) or polymer. Plastic foam and polymers simply melt at high temperature. Therefore, in one large city with such building codes, building inspectors routinely grant waivers for DAS coax cables or require extensive fire shielding of the cables, such as boxing them in drywall soffits, to afford them the two-hour burn time.

There is a need in the art for more survivable coax communication cables.

BRIEF SUMMARY

Generally, a coaxial cable is described with a ceramifiable silicone rubber dielectric or a ceramic fiber dielectric between an inner, center conductor and a coaxial, outer conductor. When subjected to temperatures exceeding 1010° C. (1850° F.), the ceramifiable dielectric maintains its structural integrity by ceramifying. That is, the resilient dielectric turns into a brittle, porous ceramic structure.

Ceramifiable silicone rubber can be comprised of inorganic flux particles and refractory particles in a polysiloxane (silicone rubber) matrix. At temperatures from about 425° C. (800° F.) to 482° C. (900° F.) the polysiloxane matrix begins to burn off. Meanwhile, the inorganic flux particles soften and flow to connect refractory materials, forming a porous ceramic structure.

Under similar high temperatures, a ceramic fiber dielectric maintains its integrity because it is composed of refractory fibers.

In addition to the dielectric, the coaxial cable has a ceramifiable silicone rubber layer or a ceramic fiber wrap layer around the outer conductor and underneath a low smoke zero halogen (LSZH, LSOH, LSOH, LSFH, or OHLS) jacket. The coax cable's outer conductor, sometimes called the ground or shield, can be corrugated or consist of a metal foil protected by a metal braiding.

Some embodiments of the invention are related to a fire resistant coaxial cable apparatus including a center conductor, a tubular ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425° C., an outer conductor surrounding the dielectric, the dielectric configured to maintain a predetermined spacing between the center conductor and the outer conductor, and a ceramic fiber wrap layer surrounding the outer conductor.

The center conductor can have a diameter of 4.6 millimeters (0.18 inches), and the ceramifiable silicone rubber dielectric can have a diameter greater than 13 millimeters (0.5 inches) or 19 millimeters (0.75 inches).

The apparatus can include a silicone glass tape between the dielectric and the outer conductor. It can also include a low smoke zero halogen outer jacket surrounding the inner jacket.

The outer conductor can include a metal foil, and the metal foil can include copper or aluminum. Either can be on a metalized tape. The cable can include a braided metal in direct contact with and surrounding the outer conductor. The braided metal can include tin-coated copper.

Alternatively, the outer conductor can include a corrugated metal. For example, the corrugated metal can have a wall thickness of 0.53 millimeters (0.021 inches), and the corrugations of the corrugated metal can have a layer thickness of 1.8 millimeters (0.070 inches). The outer conductor can include copper.

The cable can have an outer diameter of 15.7 millimeters (0.620 inches), thereby having a ½ inch nominal size, all the way to 28 millimeters (1.1 inches), thereby having a 1.1 inch nominal size, or more.

The center conductor can include a single solid wire or multiple wire strands bundled together.

Embodiments also include a fire resistant coaxial cable apparatus including a center conductor, a tubular ceramifiable silicone rubber dielectric surrounding the center conductor, the ceramifiable silicone rubber dielectric comprising inorganic flux particles and refractory particles in a polysiloxane matrix, the ceramifiable silicone rubber dielectric configured to convert from a resilient elastomer to a porous ceramic when heated above 425° C., an outer conductor surrounding the dielectric, and a ceramic fiber wrap inner jacket surrounding the outer conductor.

The ceramic fiber wrap inner jacket can include a fiber material of refractory aluminoborosilicate, aluminosilica, or alumina. The fiber material can include fibers having diameters of between 7 and 13 microns (μm).

The outer conductor can include a metal foil surrounded by a braided metal in direct contact with and surrounding the outer conductor. Alternatively, the outer conductor can include a corrugated metal.

Embodiments also include a fire resistant coaxial cable apparatus including a center conductor, a ceramic fiber wrap dielectric surrounding the center conductor, an outer conductor surrounding the dielectric, the dielectric configured to maintain a predetermined spacing between the center conductor and the outer conductor, and a ceramifiable silicone rubber inner jacket or a ceramic fiber wrap layer surrounding the outer conductor.

The outer conductor can include a metal foil surrounded by a braided metal in direct contact with and surrounding the outer conductor. Alternatively, the outer conductor can include a corrugated metal.

Embodiments include a method of installing a fire resistant coaxial cable, the method including providing a coaxial cable having a center conductor surrounded by a ceramifiable silicone rubber dielectric or a ceramic fiber wrap dielectric, which is surrounded by an outer conductor, which is surrounded by a ceramifiable silicone rubber layer or a ceramic fiber wrap inner jacket, which is surrounded by a low smoke zero halogen outer jacket. The method includes pulling or pushing the coax cable through a conduit and connecting the coax cable to an antenna of a distributed antenna system.

Embodiments include a method of testing a fire resistant coaxial cable, the method including providing a coaxial cable having a center conductor surrounded by a ceramifiable silicone rubber dielectric or a ceramic fiber wrap dielectric, which is surrounded by an outer conductor, which is surrounded by a ceramifiable silicone rubber inner jacket or a ceramic fiber wrap inner jacket, which is surrounded by a low smoke zero halogen outer jacket. The method includes subjecting the coaxial cable to 1010° C. heat, ceramifying the ceramifiable silicone rubber layer or the ceramic fiber wrap, burning at least a portion of the outer jacket from the cable, and passing an electric voltage or current signal through the coaxial cable after the ceramifying and the burning.

The ceramifying of the ceramifiable silicone rubber inner jacket can include burning away a polysiloxane matrix and melting inorganic flux particles such that the flux particles connect between refractory filler particles.

The method can include resting the coaxial cable on a metal surface, wherein the burning of the outer jacket exposes the ceramifiable silicone rubber inner jacket or the ceramic fiber wrap inner jacket to the metal surface, the ceramifiable silicone rubber inner jacket or the ceramic fiber wrap inner jacket preventing the outer conductor from contacting the metal surface.

DETAILED DESCRIPTION

Figure 1:
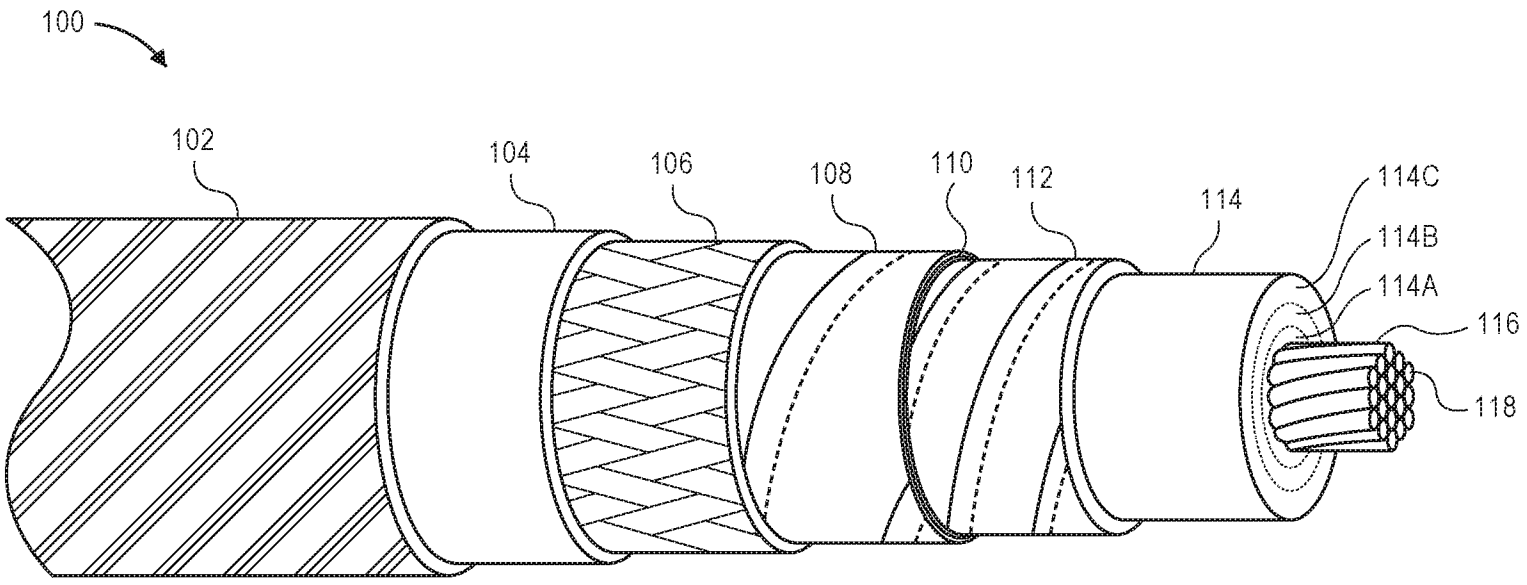
FIG. 1 is a cut-away perspective view of a coaxial cable in accordance with an embodiment.

Fire resistant coaxial cable is described. Some embodiments of the cable can survive two hours in fire conditions of 1010° C. (1850° F.), maintaining or increasing dielectric spacing and avoiding shorting to allowing radio frequency (RF) signals to pass. This coaxial cable may be suitable for meeting building codes for a distributed antenna system (DAS) without the need for fire-protective soffits, conduits, or other expensive shielding.

Flexible braided cables and durable corrugated cables, among other cable types, are described. Braided cables as described can be suitable for replacing 50Ω LMR®-600 flexible communication cable manufactured by Times Microwave Systems, Inc. of Wallingford, Conn., United States.

A "ceramifiable" material includes a material that turns from a flexible material into a ceramic when exposed to high temperatures, such as over 425° C., 482° C., 1010° C., or as otherwise known in the art. The material can be a composition of component materials that have different melting ranges. The lowest-melting temperature component materials may melt at 350° C. Between 425° C. and 482° C., other component materials of the material my devitrify, passing from a glass-like state into a crystalline state. Additives can bond refractory fillers together, forming a porous ceramic material.

An example ceramifiable polymer may be the peroxidically crosslinking or condensation-crosslinking polymer described in U.S. Pat. No. 6,387,518.

A "ceramifiable silicone rubber" includes silicone polymer (polysiloxane) with additives that cause the material to turn into a fire-resistant ceramic in high temperature fire conditions, or as otherwise known in the art. This may include peroxide crosslinking or condensation-crosslinking high consistency silicone rubber. A silicone polymer matrix can include low-melting point inorganic flux particles and refractory filler particles in a polysiloxane matrix. Example products include, but are not limited to: Ceramifiable Silicone Rubber Compound RCS-821 manufactured by Shenzhen Anpin Silicone Material Col, Ltd. of Guangdong, China; ELASTOSIL® R 502/75 compound manufactured by Wacker-Chemie GmbH of Munich, Germany; and XIAMETER® RBC-7160-70 compound manufactured by Dow Corning Corporation of Midland, Mich., United States of America.

A "ceramic fiber wrap" includes a textile that includes microscopic ceramic fibers and fillers that maintain structural integrity at high temperatures. Example products include NEXTEL® ceramic fibers and textiles manufactured by 3M Corporation of Saint Paul, Minn., United States of America. 3M NEXTEL® textiles include aluminoborosilicate, aluminosilica, and alumina (aluminum oxide $Al_2O_3$) fibers with diameters ranging from 7 microns to 13 microns. Per the World Health Organization (WHO), fiber diameters above 3 microns (with length greater than 5 microns with a length-to-diameter ration greater than 3:1) are not considered respirable.

A "refractory" material includes non-metallic material having those chemical and physical properties that make them applicable for structures, or as components of systems, that are exposed to environments above 1,000° F. (811 K; 538° C.) (ASTM C71), or as otherwise known in the art.

A "low smoke zero halogen" or "low smoke free of halogen" (LSZH or LSOH or LSOH or LSFH or OHLS) is a material classification typically used for cable jacketing in the wire and cable industry. LSZH cable jacketing is composed of thermoplastic or thermoset compounds that emit limited smoke and no halogen when exposed to high sources of heat.

FIG. 1 is a perspective view of a coaxial cable 100 that has layers cut away. The cable has a round cross section and is radially symmetric around an axial centerline.

Center conductor 116 includes nineteen strands of individual wires 118 that are bundled and twisted together. Each individual wire is nickel-plated copper.

Radially surrounding the center conductor is ceramifiable silicone rubber dielectric 114 in a cylindrical, tubular form. Center conductor 116 is centered in dielectric.

Because silicone rubber can be difficult to extrude in the thicknesses needed for proper spacing between the center and outer conductor, dielectric 114 may exhibit multiple layers that are partially cured with each other. To create the large thickness shown in the figure, ceramifiable silicone rubber layer 114A was extruded in a first batch process around the center conductor and partially cured. Ceramifiable silicone rubber layer 114B was then extruded in a second batch process around layer 114A and partially cured, forming some cross-links between the layers. Finally, ceramifiable silicone rubber layer 114C was extruded in a third batch process around layer 114B and cured, forming cross-links between the layers.

If the entire thickness of ceramifiable silicone rubber dielectric were extruded all in one batch, the silicone rubber may not harden to the point where it can support the weight of the inner conductor. If that were the case, then the inner conductor could sag or otherwise move within the soft silicone rubber, becoming uncentered. Multiple passes through an extrusion machine, each pass increasing an extrusion orifice diameter, helps prevent this problem. A tunnel of ultraviolet (UV) lights can shine onto the layers as they exit the orifice, helping to speed curing.

Ceramifiable silicone rubber layer 114C can be surrounded by wrapping it with silicone glass separator tape 112. As shown in the figure, separator tape 112 has a 25% overlap. Silicone glass separator tape 112 helps hold the thick outer layer 114C of silicone rubber dielectric 114.

Outer conductor 108 was formed from copper metallized mylar tape wrapped around separator tape 112. The metallized tape was formed with copper over mylar substrate 110.

Copper braiding 106 surrounds and is in direct contact with the copper metal of outer conductor 108. The braiding includes 36 AWG (American Wire Gauge) tin plated copper woven in a continuous fashion at a coverage of at least 85%.

Inner jacket 104 is another layer of ceramifiable silicone rubber. It surrounds braiding 106, enclosing it in a fire resistant shell.

Outer jacket 102 surrounds inner jacket 104. Outer jacket 102 is a low smoke zero halogen jacket, which protects the pliable silicone rubber of the inner jacket and slides more easily through walls and conduits. The outer jacket can be made of cross-linked irradiated polyolefin and can be colored in order to stand out from other non-emergency cables.

Example dimensions of a coax cable are shown in the following tables. These dimensions are not limiting.

TABLE 1

Ceramifiable Silicone Dielectric, Braided 1" Coax Cable

| Structure | Outer Diameter | Layer thickness | Material |
|---|---|---|---|
| Center conductor | 4.7 mm (0.185 in.) | 4.7 mm diameter | nickel plated copper, 19 strands of 0.0372" DIA |
| Dielectric | 19.8 mm (0.779 in.) | 7.5 mm | ceramifiable silicone rubber |
| Separator Tape | 20.4 mm (0.804 in.) | 0.3 mm | silicone glass with 25% nominal lap |
| Shield #1 foil | 20.5 mm (0.809 in.) | 0.06 mm | copper mylar tape with 25% nominal lap, copper side up |
| Shield #2 braid | 21.2 mm (0.834 in.) | 0.3 mm | 36 AWG tin plated copper braid, 85% min. coverage |
| inner jacket | 24.2 mm (0.954 in.) | 1.5 mm | ceramifiable silicone rubber |
| outer | 27.4 mm (1.078 in.) | 1.6 mm | low smoke |

TABLE 1-continued

| Ceramifiable Silicone Dielectric, Braided 1" Coax Cable | | | |
|---|---|---|---|
| Structure | Outer Diameter | Layer thickness | Material |
| jacket | | | zero halogen |

TABLE 2

| Ceramifiable Silicone Dielectric, Corrugated 1" Coax Cable | | | |
|---|---|---|---|
| Structure | Outer Diameter | Layer thickness | Material |
| Center conductor | 4.7 mm (0.185 in.) | 4.7 mm diameter | nickel plated copper, 19 strands of 0.0372" DIA |
| Dielectric | 19.8 mm (0.779 in.) | 7.5 mm | ceramifiable silicone rubber |
| Outer Conductor | 23.4 mm (0.920 in.) | 1.8 mm | corrugated copper |
| inner jacket | 26.4 mm (1.039 in.) | 1.5 mm | ceramifiable silicone rubber |
| outer jacket | 29.6 mm (1.165 in.) | 1.6 mm | low smoke zero halogen |

Figure 2A:
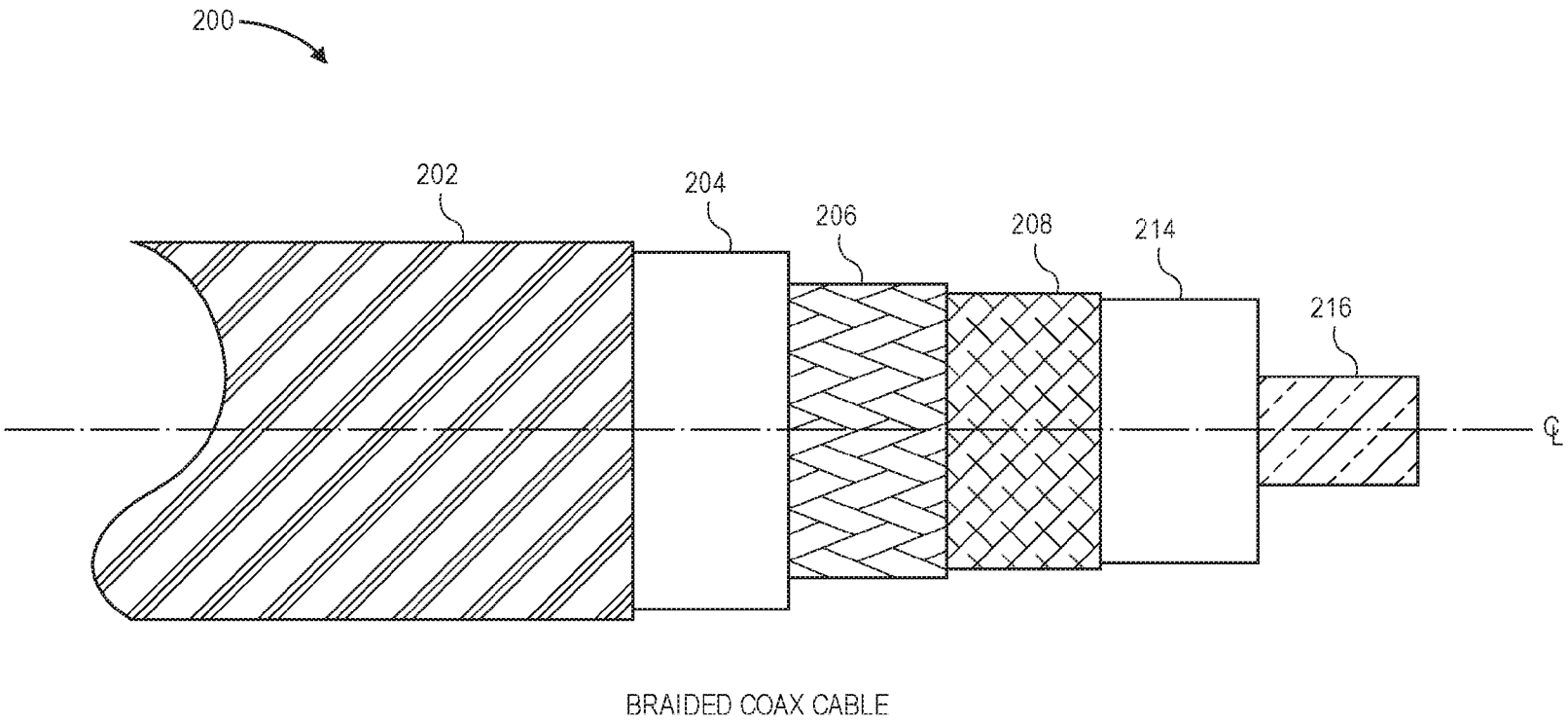
FIG. 2A is a cut-away side view of a braided coaxial cable in accordance with an embodiment.
Figure 2B:
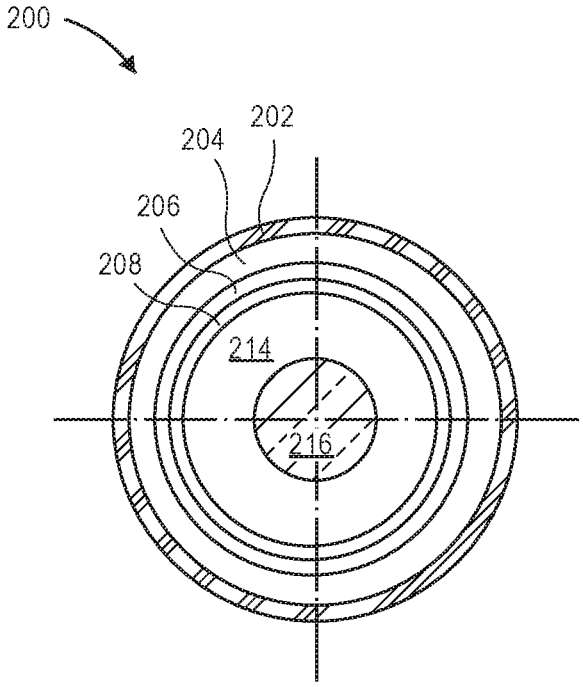
FIG. 2B is a cross section of the braided coaxial cable of FIG. 2A.

FIGS. 2A-2B are views of braided coaxial cable 200 in accordance with an embodiment. The cable has a round cross section and is radially symmetric around a centerline CL.

Similar to the embodiment shown in the previous figures, center conductor 216 is in direct contact with and surrounded by tubular ceramifiable silicone rubber dielectric 214.

The center conductor can copper or other electrically conductive metals, and it can be solid or multi-stranded. The ceramifiable silicone rubber dielectric can be replaced by ceramic fiber wrap material.

Unlike the embodiment shown in the previous figure, outer conductor 208 is in direct contact with the dielectric. It includes an aluminum or copper foil, which is in direct contact with and surrounded by copper braid 206. Foil 208 presents a smooth, constant inner diameter of conductive metal across the dielectric from the inner conductor, whilst metal braid 206 offers additional conductive pathways for electrons to flow.

Ceramic fiber wrap inner jacket 204 is in direct contact with and surrounds metal braid 206. It is woven continuously around the outer conductor such that it completely covers the outer conductor.

Alternatively, the ceramic fiber wrap inner jacket can be replaced with ceramifiable silicone rubber.

Low smoke zero halogen jacket 202 surrounds ceramic fiber wrap inner jacket 204.

Figure 3A:
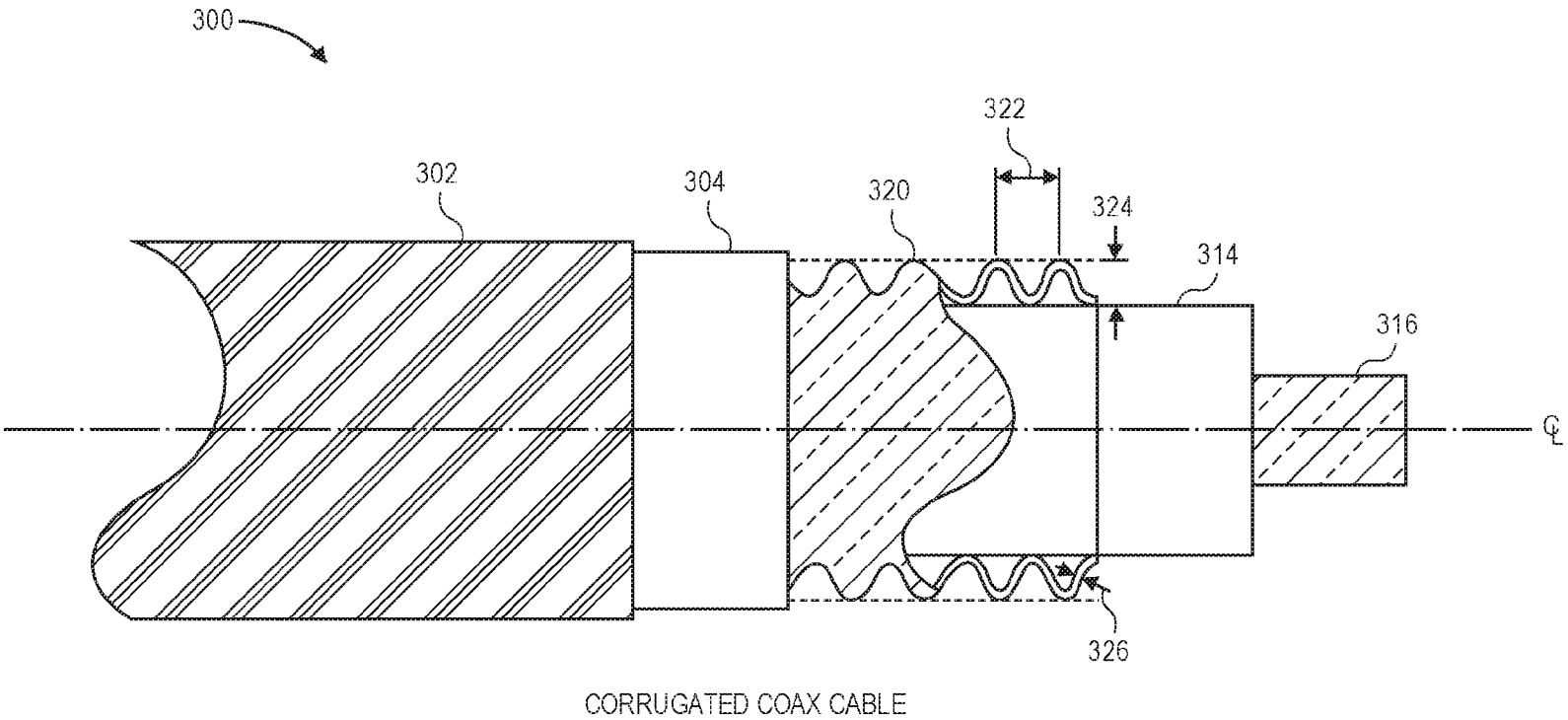
FIG. 3A is a cut-away side view of a corrugated coaxial cable in accordance with an embodiment.
Figure 3B:
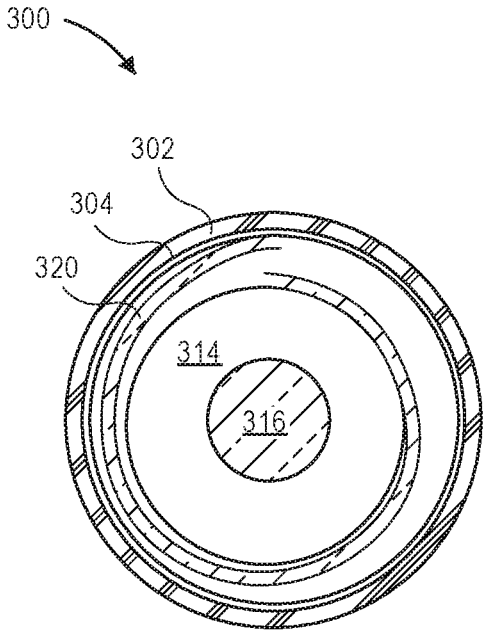
FIG. 3B is a cross section of the corrugated coaxial cable of FIG. 3A.

FIGS. 3A-B are views of corrugated coaxial cable 300 in accordance with an embodiment. The cable has a round cross section and is radially symmetric around a centerline CL.

Center conductor 316 is composed of copper or another electrically conductive metal. The center conductor can be a single solid wire (as shown) or multiple smaller strands of wires twisted and bundled together.

Center conductor 316 is in direct contact with and surrounded by tubular ceramifiable silicone rubber dielectric 314. The silicone rubber dielectric can be continuously extruded around the center conductor or extruded in layers as described above.

In some embodiments, the dielectric can be a ceramic fiber wrap with dimensions to maintain a predetermined thickness depending on the dielectric constant of the ceramic fiber wrap material and desired electrical impedance (e.g., 50Ω, 75Ω) of the cable.

Corrugated metal outer conductor 320 is in direct contact with and surrounds tubular ceramifiable silicone rubber dielectric 314. The corrugated metal outer conductor is composed of a relatively thin metal wall with regularly spaced undulations. The metal can be copper or another electrically conductive metal. An infinitesimal radial cross section of the undulations may radially symmetric, or undulations may be helical.

In the exemplary embodiment, the undulations have a constant wall thickness 326 of 0.533 mm±0.076 mm (0.021 inches±0.003 inches). An amplitude-plus-wall-thickness dimension, or layer thickness 324 of the undulations is 1.78 mm (0.070 inches). A peak-to-peak wavelength 322 of the undulations is 2 corrugations per centimeter (5 corrugations per inch).

Ceramic fiber wrap layer 304 directly contacts and surrounds corrugated metal outer conductor 320. Ceramic fiber wrap layer is woven from a ceramic fiber yarn around the outer conductor such that it completely covers the outer conductor.

Alternatively, the ceramic fiber wrap layer can be replaced with ceramifiable silicone rubber.

Low smoke zero halogen jacket 302 surrounds ceramic fiber wrap layer 304. The jacket protects the cable from damage when it is fed and pulled through conduits. It also offers a relatively slippery surface to minimize force needed to push or pull the cable along conduits and raceways.

Further example dimensions of a braided coax cables are shown in the following tables for ⅞" and ½" embodiments. These dimensions are not limiting.

TABLE 3

| Ceramifiable Silicone Dielectric, Braided ⅞" Coax Cable | | | |
|---|---|---|---|
| Structure Type | Outer Diameter | Layer thickness | Material |
| Center conductor | 4.57 mm (0.180 in.) | 0.180 in. diameter | annealed copper |
| Dielectric | 15.24 mm (0.60 in.) to 19.81 mm (0.78 in.) | 0.21 in. to 0.30 in. | ceramifiable silicone rubber |
| Outer conductor | 15.5 mm (0.61 in.) to 20.1 mm (0.79 in.) | 0.005 in. | aluminum tape |
| Overall braid | 15.6 mm (0.64 in.) to 20.8 mm (0.82 in.) | 0.015 in. | tinned copper |
| Fire jacket | 15.7 mm (0.66 in.) to 21.0 mm (0.82 in.) | 0.0035 in. | ceramic fiber wrap |
| Jacket | 15.9 mm (0.72 in.) to 21.2 mm (0.83 in.) | 0.003 | low smoke zero halogen |

TABLE 4

| Ceramifiable Silicone Dielectric, Braided ½" Coax Cable | | |
|---|---|---|
| Structure Type | Outer Diameter | Material |
| Center conductor | 4.57 mm (0.180 in.) | annealed copper |
| Dielectric | 11.43 mm (0.450 in.) | ceramifiable silicone rubber |
| Outer conductor | 11.68 mm (0.460 in.) | aluminum tape |
| Overall braid | 12.45 mm (0.490 in.) | tinned copper |
| Fire jacket | 14.22 mm (0.560 in.) | ceramic fiber wrap |
| Jacket | 15.75 mm (0.620 in.) | low smoke zero halogen |

Figure 4:
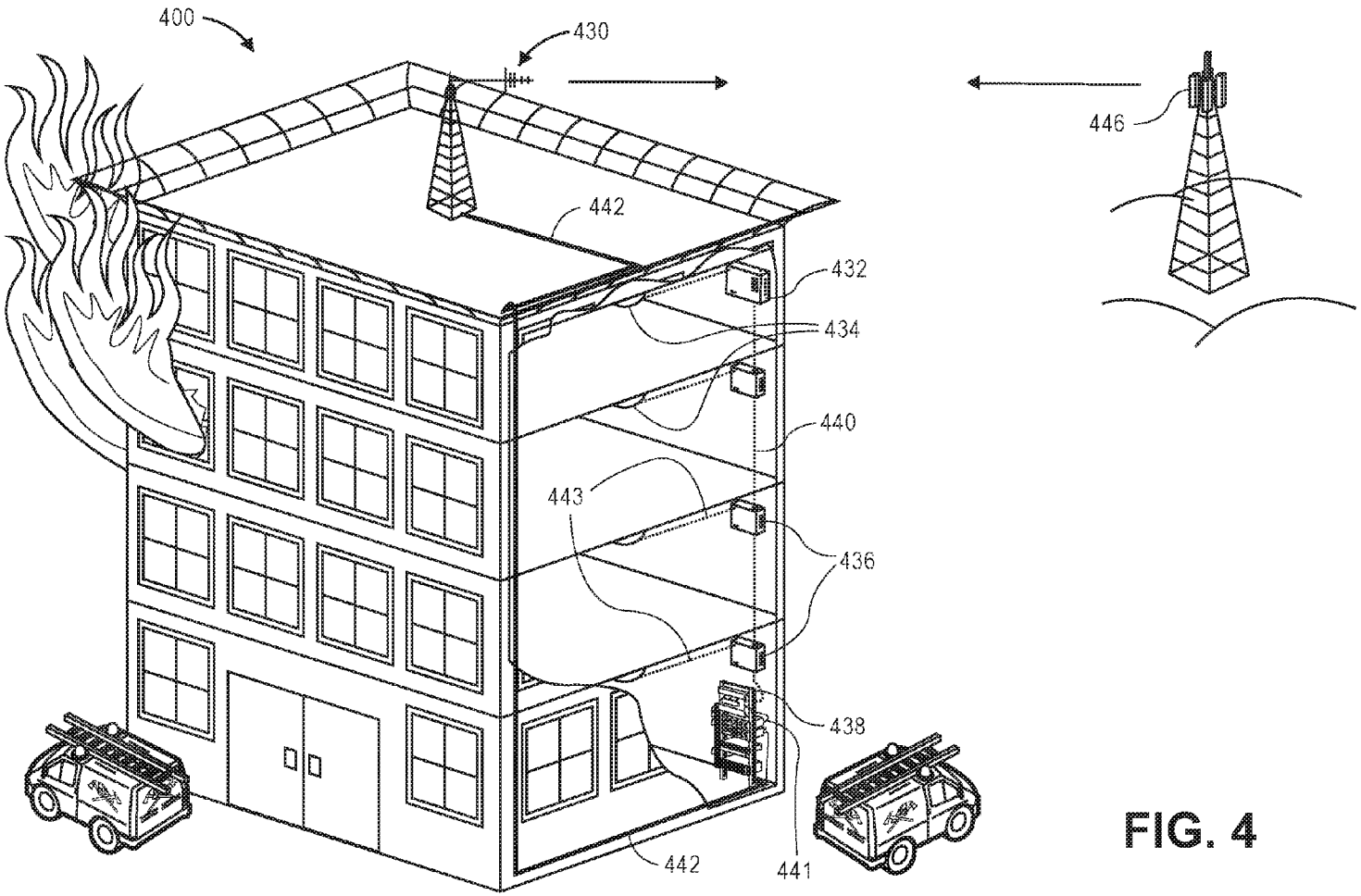
FIG. 4 is an illustration of installed cables in a building distributed antenna system in accordance with an embodiment.

FIG. 4 is an illustration of installed cables in a building distributed antenna system in accordance with an embodiment.

Building 400 has a cellular distributed antenna system (DAS) and/or Emergency Responder Radio Coverage System (ERRCS) DAS installed. That is, a fire resistant coax cable as described above has been pulled or pushed through conduit and affixed inside and outside of the building, connecting to antennae and other systems.

Head-end rack 438 has been installed in an equipment room on the ground floor of building 400. Within head-end rack 438 is housed an optical master unit and other rack-mounted devices. Fiber optic cable 440 connects the head-end rack 438 to remote access units, including optical signal splitters 436 on each floor and remote access unit 432 on the top floor. Optical signal splitters 436 and remote access unit 432 provide the functions of converting and amplifying optical to electrical signals and back again for their respective floor's antenna units. Signal splitters 436 pull off and repeat optical signals from optical cables 440.

On each floor are indoor antennas 434 that wirelessly connect with users' cellular telephones. Antennae 434 are connected to optical signal splitters 436 and remote access unit 432 by coax cables 443, in accordance with an embodiment.

Coax cables 443 are fire resistant in accordance with embodiments herein. Coax cables 443 can maintaining operation for over two hours at high temperatures. Therefore, building codes may not require coax cable 443 to be shielded from open air. That is, no additional drywall soffits, fire proof conduit, or other expensive structures may be needed to comply with building codes.

Within the head-end rack 438, fire resistant coax cable 441 can connect different rack-mounted devices. Although the equipment room in which head-end rack is situated may be fire proof, this additional cabling may incrementally harden the system to fire damage.

Fire resistant coax cable 442 runs from head-end rack 438 up the side of the building to roof mounted donor antenna 430. Donor antenna 430 is pointed at local cell tower 446 for an optimal signal.

In operation, communications from end users' cell phones goes to indoor antennae 434 and are then fed to optical splitters 436 through fire resistant coax cables 443. Fiber optic cables 440 bring the communications signals to the head end unit on the ground floor, which then sends the signals through fire resistant coax cable 442 to the roof. At the roof, donor antenna 430 sends the signals from coax cable 442 to cell tower 446. Opposite direction communication signals follow a reverse path.

During a building fire, explosion, or other emergency, coax cables 443, 442, and 441 may be exposed to an inferno of high temperatures. The low smoke zero halogen jacket may burn away. Yet while the insulation of other wires may burn and sublimate and allow their conductors to short out, an embodiment's ceramifiable silicone rubber or ceramic fiber wrap surrounding the outer conductor largely maintains its strength and structural integrity. The ceramic matrix from the ceramified silicone rubber, or the ceramic fiber wrap, does not allow the outer conductor of the coax to electrically short against metal conduit or other wires.

Further, the dielectric, so important in coaxial cables for its impedance and maintaining spacing between an inner conductor and coaxial outer conductor, merely ceramifies under the intense heat. Its polysiloxane matrix melts away while inorganic flux particles flow and join refractory particles. This leaves a microporous ceramic material. Although the resulting ceramic material may be brittle, nothing should move the cable because it is already installed an in place. At least until first responders can rescue victims and put out the blaze, their communications can depend on the wires.

After the fire is out, the ceramified coax cables may be replaced.

Figure 5:
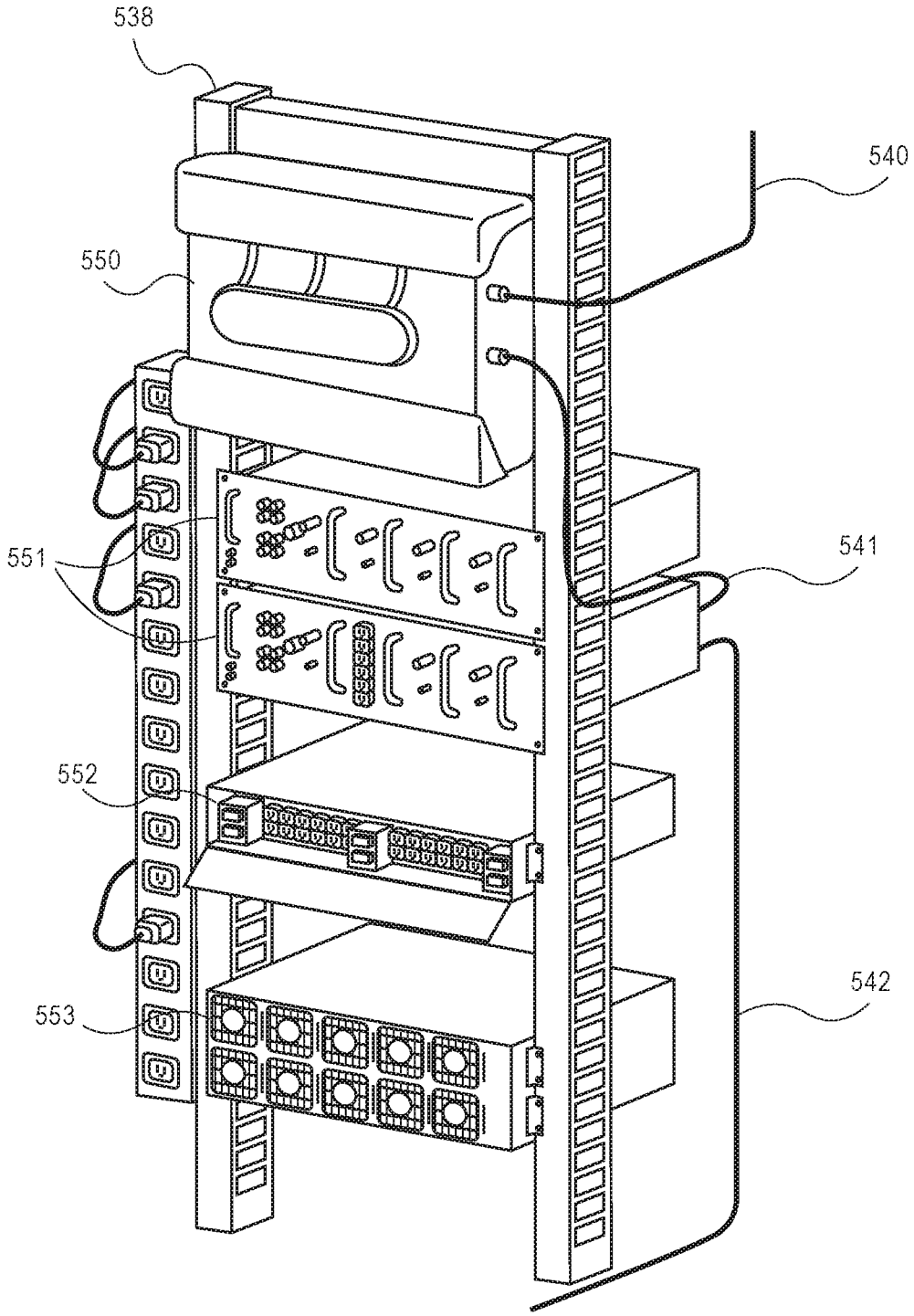
FIG. 5 illustrates of a central processing rack in accordance with an embodiment.

FIG. 5 illustrates of a central processing rack 538 in accordance with an embodiment. Fiber optic cable 540 extends from optical master unit (OMU) 550 to the DAS field (of indoor antennae). Bi-directional amplifier (BDA) 551 is connected to OMU 550 by fire resistant coax cable 541. Fire resistant coax cable 542 connects BDA 551 to the roof antenna. Uninterruptable power supply (UPS) 552 maintains battery power when power is cut. Power supply 553 supplies electricity during normal, day-to-day operation.

Figure 6:
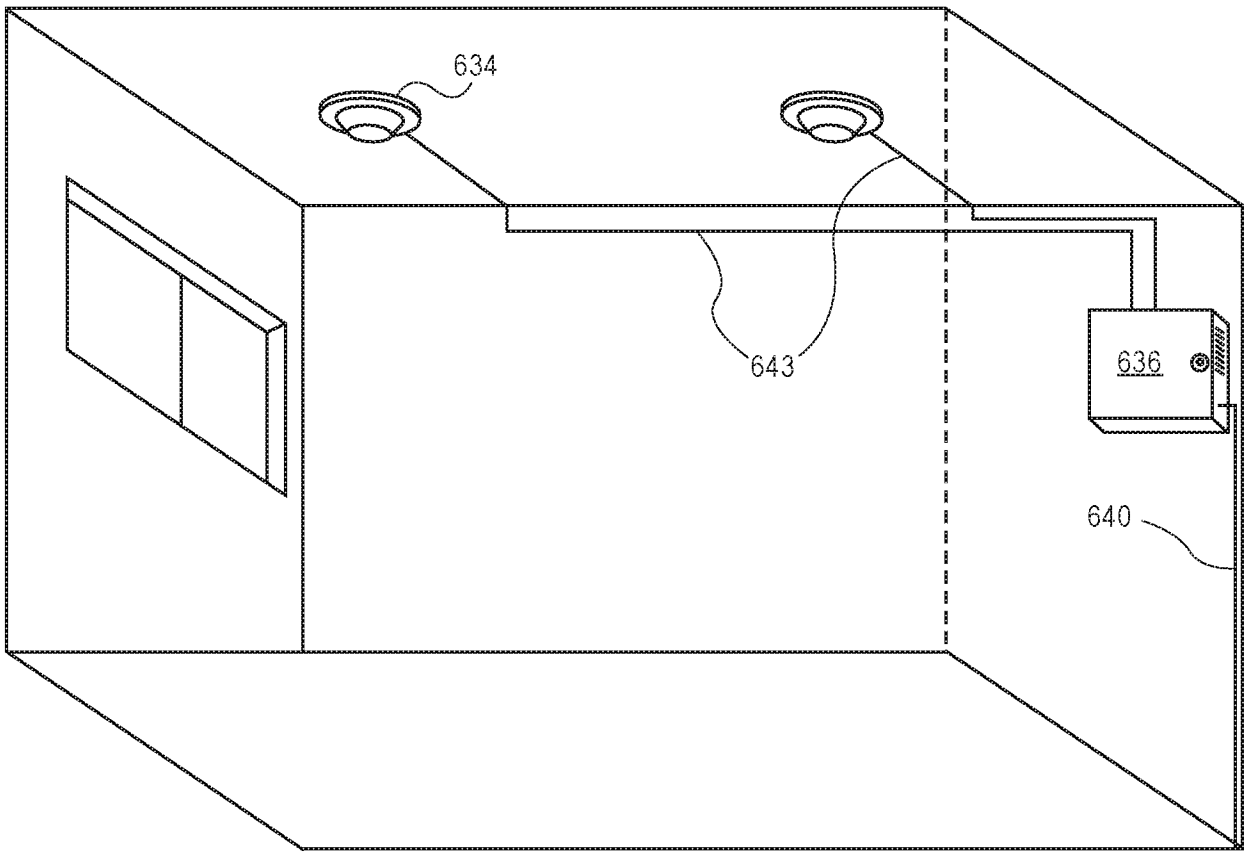
FIG. 6 illustrates coax cables connecting distributed antennas to an antenna tap in accordance with an embodiment.

FIG. 6 illustrates fire resistant coax cables connecting distributed antennas to an antenna tap in accordance with an embodiment. Note that the cable may run on the ceiling where the heat may be most intense during a fire. Indoor antennae 634 are connected with optical splitter 636 via fire resistant coax cables 643. Fiber optic cable 640 connects optical splitter 636 with the head-end unit.

As will be apparent to one of skill in the art, embodiments of the fire resistant coax cable can be used in different configurations of the DAS field, such as those with no fiber optic cables, or where the top floor of a building houses the bi-directional amplifier. The fire resistant coax cable can be used in non-DAS systems, as in anywhere a coax cable is needed to survive high temperatures. For example, such cables may be used in aircraft and other vehicles, mines and tunnels, power plants, etc.

Testing fire resistant coaxial cable in accordance with embodiments are envisioned. Such testing can include providing a coaxial cable having a center conductor surrounded by a ceramifiable silicone rubber dielectric or a ceramic fiber wrap dielectric, which is surrounded by an outer conductor, which is surrounded by a ceramifiable silicone rubber layer or a ceramic fiber wrap layer, which is surrounded by a low smoke zero halogen jacket. The cable can be subjected to high temperatures, such as 400° C., 425° C., 482° C., 500° C., 750° C., 850° C., 950° C., 1000° C., 1010° C., or as otherwise known in the art. The heat causes ceramification of the ceramifiable silicone rubber layer. The ceramic fiber wrap can withstand the heat. The heat may burn at least a portion of the jacket from the cable.

In order to test the cable, one can pass an electric voltage or current signal through the coaxial cable during or after the ceramifying and the burning. The cable can be tested up to and including destruction.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. A fire resistant coaxial cable apparatus comprising:

a center conductor;

a tubular ceramifiable silicone rubber dielectric surrounding the center conductor and having a radial thickness greater than 4.2 millimeters, the ceramifiable silicone rubber dielectric comprising inorganic flux particles and refractory particles in a poly siloxane matrix, the ceramifiable silicone rubber dielectric configured to convert from a resilient elastomer to a porous ceramic when heated above 425° C.;

an outer conductor surrounding the dielectric; and a ceramifiable silicone rubber inner jacket surrounding the outer conductor.

2. The cable apparatus of claim 1 wherein the center conductor has a diameter of 4.6 millimeters (0.18 inches).

3. The cable apparatus of claim 1 wherein the ceramifiable silicone rubber dielectric has a radial thickness greater than 7.2 millimeters.

4. The cable apparatus of claim 1 further comprising:

a silicone glass tape between the dielectric and the outer conductor.

5. The cable apparatus of claim 1 further comprising:

a low smoke zero halogen outer jacket surrounding the inner jacket.

6. The cable apparatus of claim 1 wherein the outer conductor comprises:

a metal foil; and a braided metal in direct contact with and surrounding the outer conductor.

7. The cable apparatus of claim 6 wherein the metal foil comprises a copper-metalized tape.

8. The cable apparatus of claim 6 wherein the braided metal comprises tin-coated copper.

9. The cable apparatus of claim 1 wherein the outer conductor comprises a corrugated metal.

10. The cable apparatus of claim 9 wherein the corrugated metal has a wall thickness of 0.53 millimeters (0.021 inches) and corrugations of the corrugated metal have a layer thickness of 1.8 millimeters (0.070 inches).

11. The cable apparatus of claim 1 where in the center conductor comprises a single solid wire or multiple strands of wire.

12. A fire resistant coaxial cable apparatus comprising:

a center conductor;

a tubular ceramifiable silicone rubber dielectric surrounding the center conductor and having a radial thickness greater than 4.2 millimeters, the ceramifiable silicone rubber dielectric comprising inorganic flux particles and refractory particles in a poly siloxane matrix, the ceramifiable silicone rubber dielectric configured to convert from a resilient elastomer to a porous ceramic when heated above 425° C.;

an outer conductor surrounding the dielectric; and a ceramic fiber wrap inner jacket surrounding the outer conductor.

13. The cable apparatus of claim 12 wherein the ceramic fiber wrap inner jacket comprises fiber material selected from the group consisting of refractory aluminoborosilicate, aluminosilica, and alumina.

14. The cable apparatus of claim 13 wherein the ceramic fiber wrap inner jacket comprises fibers having individual fiber diameters of between 7 and 13 microns (μm).

15. The cable apparatus of claim 12 wherein the outer conductor comprises:

a metal foil; and a braided metal in direct contact with and surrounding the outer conductor.

16. The cable apparatus of claim 12 wherein the outer conductor comprises a corrugated metal.

17. The cable apparatus of claim 12 where in the center conductor comprises a single solid wire or multiple strands of wire.

18. A fire resistant coaxial cable apparatus comprising:

a center conductor;

a ceramic fiber wrap dielectric surrounding the center conductor;

an outer conductor surrounding the dielectric, the ceramic fiber wrap dielectric configured to maintain a predetermined spacing between the center conductor and the outer conductor, the predetermined spacing fixed at a constant between 3.4 millimeters and 7.6 millimeters; and a ceramifiable silicone rubber inner jacket or a ceramic fiber wrap inner jacket surrounding the outer conductor.

19. The cable apparatus of claim 18 wherein the outer conductor comprises:

a metal foil; and a braided metal in direct contact with and surrounding the outer conductor.

20. The cable apparatus of claim 18 wherein the outer conductor comprises a corrugated metal.

* * * * *